US006494633B1

(12) United States Patent
Crosby et al.

(10) Patent No.: US 6,494,633 B1
(45) Date of Patent: Dec. 17, 2002

(54) TRANSPORTABLE INK JET PRINTER APPARATUS

(75) Inventors: Nathan Edward Crosby, Independence, KY (US); William Henry Reed, Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 57 days.

(21) Appl. No.: 09/871,106

(22) Filed: May 31, 2001

(51) Int. Cl.[7] ..... B41J 3/36; B41J 29/56
(52) U.S. Cl. ..... 400/668; 400/663; 400/88
(58) Field of Search ..... 400/88, 663, 664, 400/691, 693

(56) References Cited

U.S. PATENT DOCUMENTS

| | | | | |
|---|---|---|---|---|
| 3,623,783 | A | | 11/1971 | Gallant |
| 3,735,701 | A | | 5/1973 | Ackerman |
| 4,634,304 | A | | 1/1987 | Narushima et al. |
| 4,760,492 | A | | 7/1988 | Walsh |
| 4,876,956 | A | | 10/1989 | Riley et al. |
| 5,331,580 | A | | 7/1994 | Miller et al. |
| 5,344,248 | A | | 9/1994 | Schoon et al. |
| 5,480,248 | A | | 1/1996 | Tanahashi |
| 5,520,470 | A | | 5/1996 | Willett |
| 5,555,489 | A | | 9/1996 | Keskinen |
| 5,757,403 | A | | 5/1998 | Nagashima |
| 5,816,725 | A | | 10/1998 | Sherman et al. |
| 5,967,682 | A | | 10/1999 | Tanahashi |
| 6,341,838 | B1 | * | 1/2002 | Miyauchi ..... 347/104 |

FOREIGN PATENT DOCUMENTS

| | | | | |
|---|---|---|---|---|
| GB | 2338454 | A | * 12/1999 | ..... B41J/29/56 |
| JP | 05031912 | A | * 2/1993 | ..... B41J/2/165 |
| JP | 09290547 | A | * 11/1997 | ..... B41J/29/00 |
| JP | 11157188 | A | * 6/1999 | ..... B41J/29/54 |

* cited by examiner

*Primary Examiner*—Daniel J. Colilla
(74) *Attorney, Agent, or Firm*—Seth M. Nehrbass; Jacqueline M. Despit

(57) ABSTRACT

An easily transportable ink jet printer apparatus provides a chassis that includes an ink jet print head having nozzles for dispensing ink, the print head being movably mounted to the chassis along the travel path. The chassis also includes a paper output tray movably mounted to the chassis between printing and carrying positions. The print head has a parked position at a selected position along the travel path when not printing in which the nozzles are capped to prevent clogging of the nozzles by dried ink. A locking member is movably mounted to the chassis between carrying and printing positions. The locking member holds the print head in the parked position when moved into the carrying position. The locking member can also be used to lock other components such as paper storage tray, paper exit tray, and cover. The locking member can be a handle with a gripping surface thereon, enabling a user to grasp and lift the handle to a transport position that secures a component or components of the printer (e.g., print head carrier, paper storage tray, paper exit tray, cover).

53 Claims, 4 Drawing Sheets

TRANSPORTABLE INK JET PRINTER APPARATUS

BACKGROUND OF THE INVENTION

1. Field of the Invention

The present invention relates to ink jet printers, and more particularly to an improved ink jet printer that is easily transportable and wherein a locking member, movable between printing and transport positions, locks various components of the printer in a secure position when it is rotated from a first or "printing" position to a second or "carrying" position. The locking member can be in the form of a handle for carrying the printer from one location to another.

2. General Background of the Invention

Ink jet printers are common, commercially available printer devices that are typically used in conjunction with a desktop or laptop computer. In recent years, a new class of personal printer called a "photo printer" or "appliance printer" has become commercially available. An example is the Lexmark Photojet Printer 5770. These new photo or appliance printers have expanded the options for printing color photographs, especially those captured with digital cameras.

Some photo printers may also function as a personal computer printer. However the distinguishing characteristic in this definition is that photo printers or appliance printers have the ability to print photos as an appliance, without requiring a general purpose personal computer.

These appliance printers typically have an integrated photo controller that functions as a special purpose computer capable of processing the digital image and feeding appropriate data to the print mechanism. These appliance printers typically utilize ink jet or a dye diffusion print technology. These "personal computer free"appliance printers will soon be (if not already are) available that are capable of printing other file types beyond photo image files.

Since printer appliances are free of the desktop computer, there is likelihood that the printer will frequently be relocated by the user. However, when a user transports an ink jet printer, various components of the printer can be damaged if they are repositioned or abruptly moved during transport.

BRIEF SUMMARY OF THE INVENTION

The present invention provides an improved ink jet printer apparatus that features a locking mechanism that is positioned out of the way when printing, but is repositioned when the printer apparatus is to be transported. This locking mechanism is movable between a first "printing" position and a second "carrying" position. The action of repositioning the locking member fixes into place one or more printer components such as, for example, the ink jet carrier, access cover, and paper tray(s). In this way, the printer can be more safely and conveniently relocated. In general every ink jet printer has a chassis or frame to which various components are attached. One such component is an ink jet carrier that moves in relation to a piece of paper to be printed. The ink jet carrier has one or more ink jet print heads that removably attach to the ink jet carrier. As used herein, the term "ink jet carrier" should be construed in the broadest sense to mean any carrier structure that moves a print head in relation to a piece of paper to be printed.

With the improved printer of the present invention, when the printer has been transported to a selected location and is ready to be set up again for printing operation, the locking mechanism is repositioned so that the fixed components are then freed.

In the preferred embodiment, the locking member is in the form of a handle. The handle is preferably the locking member so that a user can transport the printer easily with one hand while simultaneously securing one or more movable printer components.

The handle can provide a cam surface. The cam surface on the handle pushes a carrier lock into a position that prevents the ink jet carrier portion of the apparatus from moving out of a selected "maintenance" position. The ink jet carrier holds a print head that has nozzles for dispensing ink. The print head carrier is movably mounted to the chassis along a travel path. The ink jet print head has a parked or maintenance position when not printing in which the nozzles are capped to prevent clogging of the nozzles by dried ink.

The locking member can lock other components into position such as a paper tray (storage tray and/or exit tray).

The cam surface of the locking member can be used to push a carrier lock into position that blocks the path of the ink jet carrier. The carrier lock drops into the ink jet carrier's path when the exit tray is closed and prevents the ink jet carrier from moving out of a "capped" position during transport. Ink jet printers are desirably capped when the ink jet carrier is normally "parked" in a maintenance station. This capping of the jets prevents clogging of the nozzle by dried ink. U.S. Pat. No. 6,168,257 B1, incorporated herein by reference, discloses such a maintenance station with ink jet carrier print head and capping mechanism.

One embodiment of the present invention involves movement of the paper tray. Closing the paper storage tray actuates latches for securing both the access cover and exit the paper tray. This feature of the invention thus locks multiple components into a secured position when the locking member (for example, handle) is rotated from its first "printing" position to the second "carrying" position. The locking member closes the paper storage tray and simultaneously actuates a latch that secures the access cover. Securing the cover prevents it from swinging open once the paper tray is closed. An additional component that is secured is the paper exit tray. Closing the paper storage tray actuates a latch member at the bottom of the paper storage tray that secures the paper exit tray. The exit tray latch can be cantilevered to allow the tray to be stowed while the latch is locked. Once the paper exit tray is stowed with the paper storage tray closed, it is held in that position until the paper storage tray is opened. The access cover latch can allow the cover to be opened before any parts break in case the consumer attempts to pick the printer up by the cover.

The present invention thus provides an easily and safely transportable ink jet printer apparatus. The apparatus has a chassis that includes a paper storage tray that can be movably mounted to the chassis between "printing" and "carrying" positions. The chassis includes an ink jet carrier that has a print head having nozzles for dispensing ink. The ink jet carrier is movably mounted to the chassis along a selected travel path. A known paper handling mechanism on the chassis is provided that moves the paper from the storage tray to the print head. The ink jet carrier has a parked position when not printing in which the print head nozzles are capped to prevent clogging of the nozzles by dried ink.

A locking member (preferably in the form of a handle) is movably mounted to the chassis between "carrying" and "printing" positions. The locking member can be used to secure one or more other components of the printer when it is moved to the carrying position.

The apparatus can include a carrier lock that is movably attached to the chassis, the carrier lock occupying a locking position in between the locking member and the ink jet carrier when the locking member is moved to the carrying position. The carrier lock has an end portion that engages the handle during use at least at some time during operation.

The chassis can provide an access cover that is movable between printing and carrying positions. The access cover is secured when the locking member (e.g., handle) is moved to the carrying position.

The chassis can provide an access cover and an exit tray. The access cover and the exit tray can be secured when the handle is moved to the carrying position.

The handle can provide a cam or cam surface that contacts the print head when the handle is moved to the carrying position, securing it against movement. The cam surface preferably pushes the carrier lock to engage the print head in the locking position. The cam preferably also closes the paper tray when the handle is moved into the carrying position. The carrier lock preferably drops into the travel path of the print head when the exit paper tray is closed to thereby prevent the carrier from moving out of the capped position during transport.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
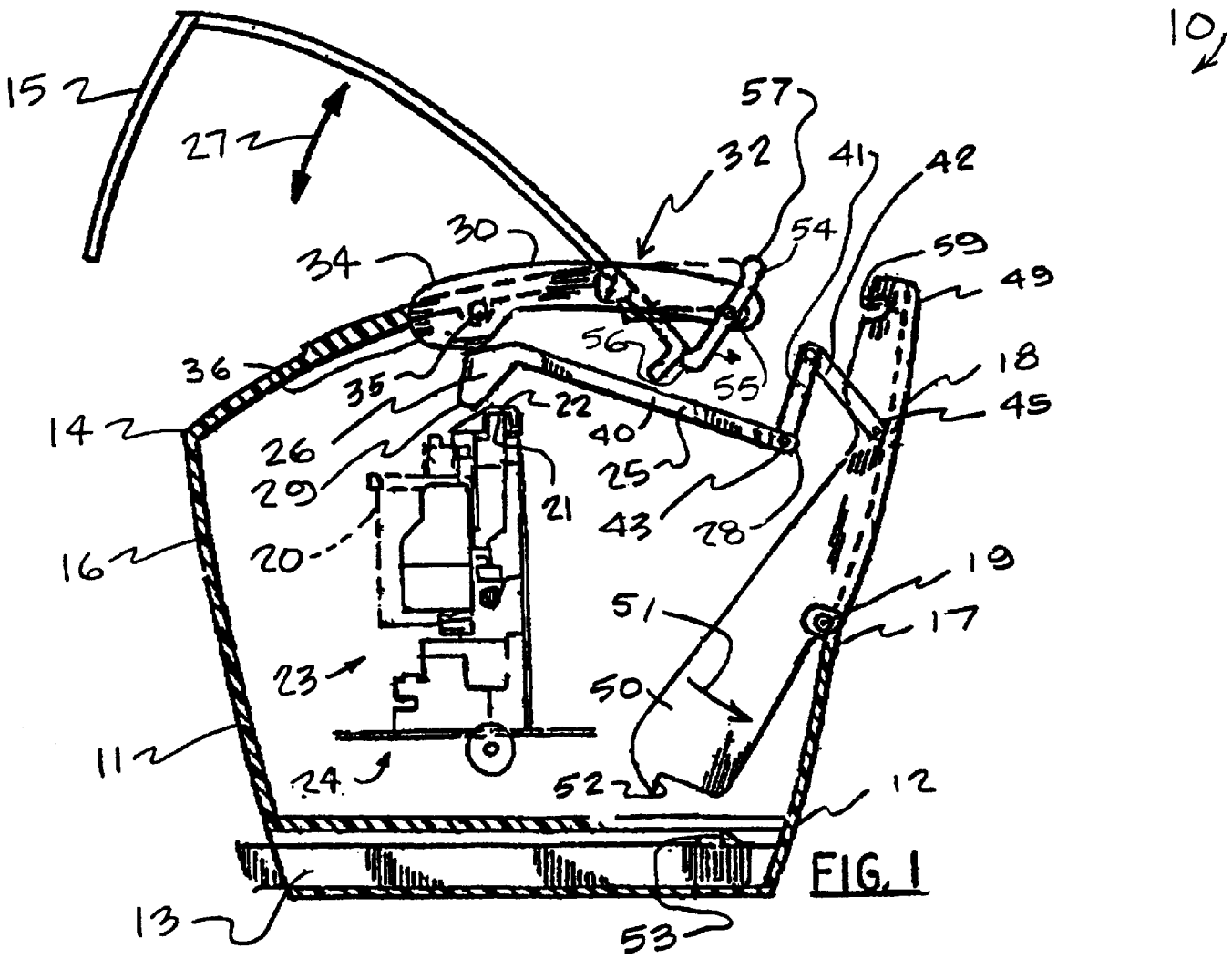
FIG. 1 is a side sectional view of a first embodiment of the apparatus of the present invention showing the cover in an elevated position, the paper storage tray in an operating position, and the locking member in a printing position.
Figure 2:
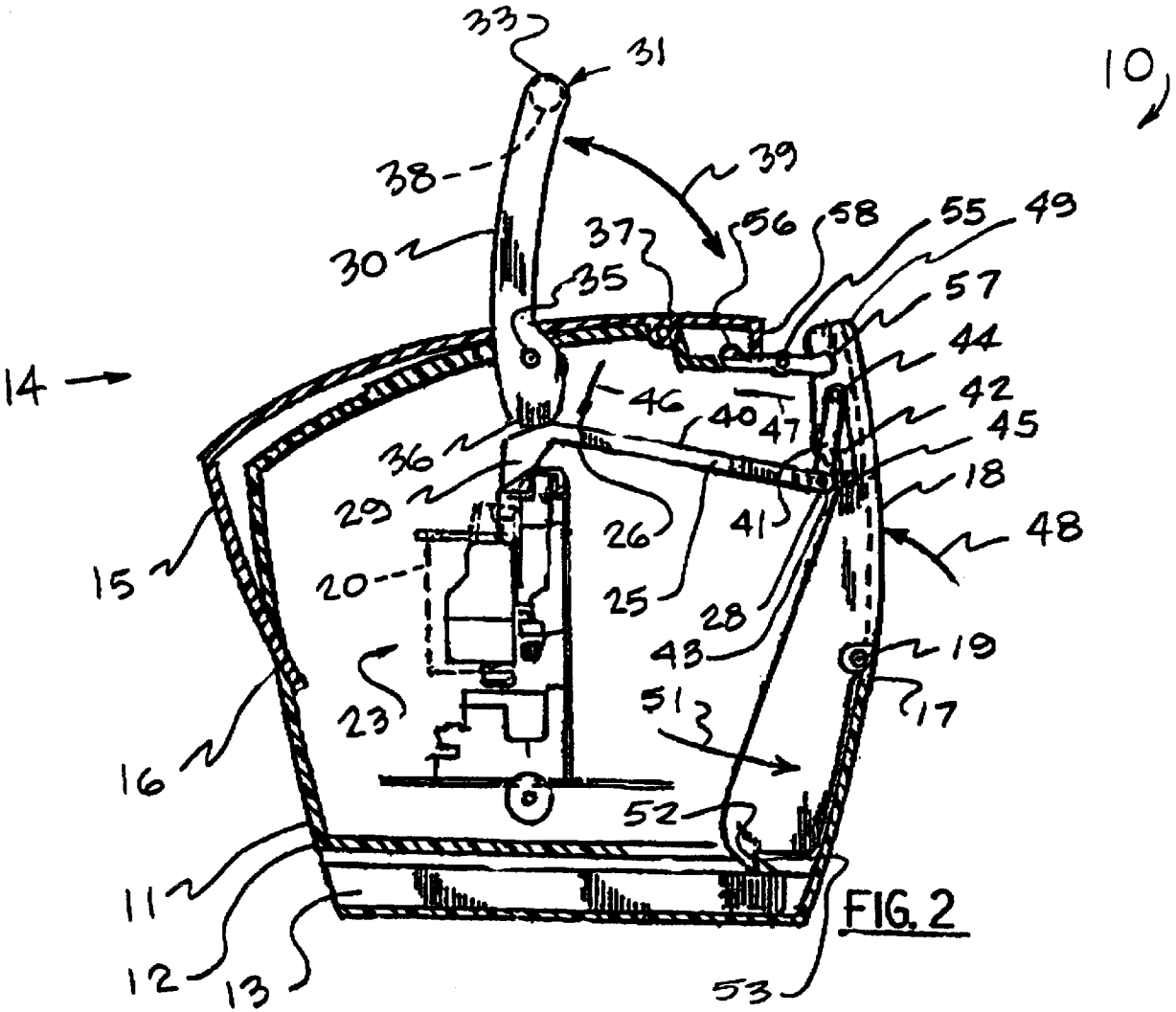
FIG. 2 is a side sectional view of the first embodiment of the apparatus of the present invention showing a transport or carrying position.

FIGS. 1–2 show the preferred embodiment of the apparatus of the present invention designated generally by the numeral 10. Ink jet printer 10 includes a chassis 11 having a lower end portion 12. The lower end portion 12 contains paper exit tray 13. Chassis 11 also has an upper end portion 14 that can be provided with a cover 15. The cover 15 can be opened and closed as indicated schematically by the arrow 27 in FIG. 1.

Figure 3:
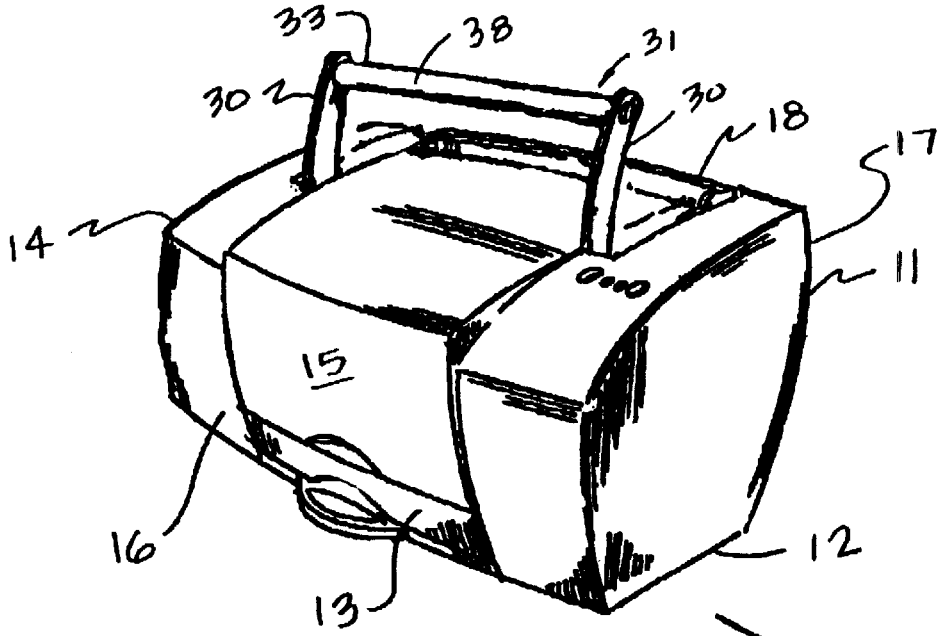
FIG. 3 is perspective view of a second embodiment of the apparatus of the present invention showing a transport or carrying position.

Chassis 11 has a front 16 and rear 17. The front 16 typically provides access to a ink jet carrier 23 that supports a print head 20. The rear 17 portion of chassis 11 supports paper storage tray 18. The paper storage tray 18 is preferably pivotally attached to chassis 11 at pivot 19. In FIG. 1, the paper storage tray 18 is shown in an operating, printing position. In FIG. 2, the paper storage tray 18 is shown in a closed, transport position. It should be understood that the terms "carrying" and "transport" refer to the position shown in FIGS. 2 and 3. In this position, the apparatus 10 can easily be transported by a user from one location to another. As used herein, the term "printing" refers to the position shown in FIGS. 1 and 4. In the printing position (FIGS. 1 and 4) cover 15 is preferable closed, but can be open. The FIG. 1 position shows the paper storage tray opened to enable a user to access it and also shows the locking member or handle 30 in a generally horizontal position. In such a horizontal position, the handle 30 does not lock the various components. Various components are locked during the transport position of FIG. 2.

Figure 4:
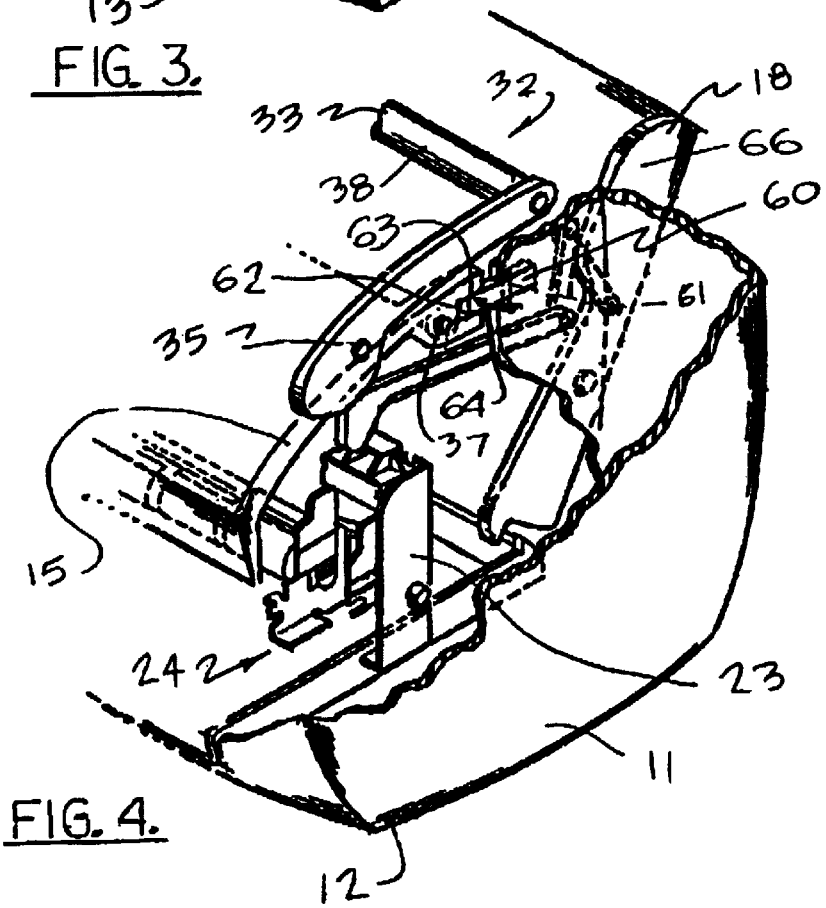
FIG. 4 is a partial perspective, partially cutaway view of the second embodiment of the apparatus of the present invention shown in an operating, printing position".
Figure 5:
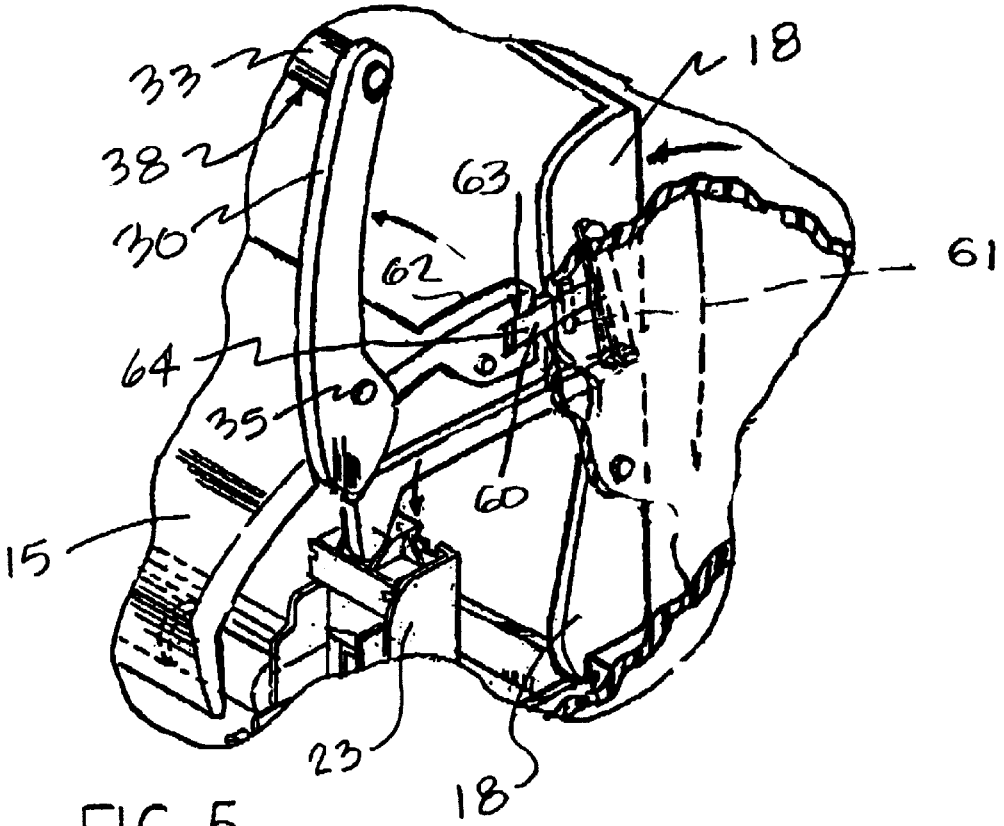
FIG. 5 is a partial perspective, partially cut away view of the second embodiment of the apparatus of the present invention shown in a transport or carrying position and the access cover locked in a closed position.
Figure 6:
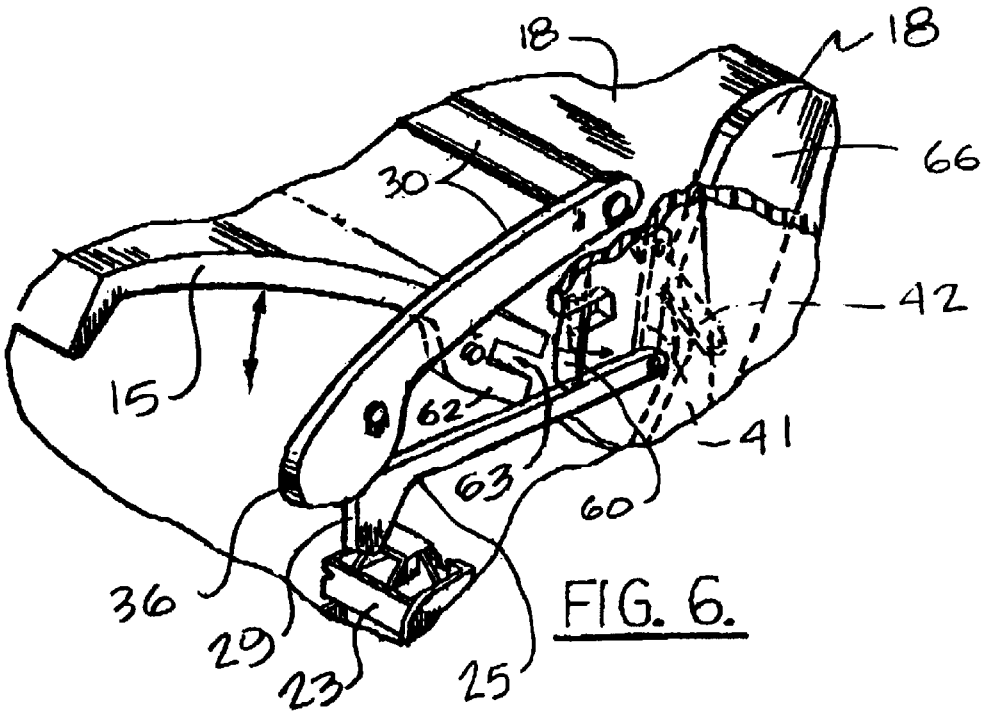
FIG. 6 is a partial perspective, partially cut away view of the second embodiment of the apparatus of the present invention shown in an operating, printing position and illustrating the access cover in an unlocked operating position.

Ink jet carrier 23 carries print head 20 that includes a plurality of ink jets, each having one or more nozzles. Ink jet carrier 23 rides upon a rail 21 at bearing surface 22. A capping mechanism caps the nozzles of the print head 20 when the carrier 23 is in a parked position, as shown in FIGS. 2 and 4. When the ink jet carrier 23 assumes the parked or maintenance position designated by the numeral 24, the nozzles of the print head 20 are capped to prevent clogging of the nozzles by dried ink. The capping of nozzles to prevent clogging of the nozzles by dried ink is known in the art for ink jet printers. The capping mechanism is disclosed more fully in U.S. Pat. No. 6,168,257 B1, which is hereby incorporated herein by reference.

Locking member 30 is movable between the transport position or carrying position of FIG. 2 and the printing position of FIG. 1, the movement being indicated by arrow 39 in FIG. 2. The locking member 30 can be a handle that includes a gripping surface 38 that is typically grabbed by a user's hand when it is desired to transport the printer 10. The carrying position is indicated generally by the numeral 31 in FIGS. 2 and 3. The printing position is indicated generally by the numeral 32 in FIGS. 1 and 4.

Locking member 30 can be pivotally mounted to chassis 11 at pivot 35. Handle 30 has an upper end portion 33 that includes gripping surface 38. Handle 30 has a lower end portion 34 that includes pivot 35 and cam surface 36.

A locking linkage 25 comprised of longer link 40 and smaller links 41, 42 has first 26 and second 28 end portions. The first 26 end portion of linkage 25 can be in the form of an enlarged carrier lock 29 that engages print head 20 (see FIG. 2) in the locking or transport position.

End portion 28 of locking linkage 25 has smaller links 41, 42. End portion 28 of locking linkage 25 is pivotally connected to housing 11 at pivot 43. Long link 40 and short link 41 are connected together so that they can both rotate as a unit upon pivot 43. When locking member 30 is rotated (see arrow 39) to a transport, locking position of FIGS. 2 and 3, cam surface 36 forces carrier lock 29 down until carrier lock 29 engages ink jet carrier 23. The carrier lock 29 drops in the direction of arrow 46 into with the carrier 23 path and prevents the ink jet carrier 23 and its print head 20 from moving out of a "capped" position during transport by a user. At the same time that carrier lock 29 secures carrier 23 and its print head 20, small link 41 rotates forward upon pivot 43 in the direction of arrow 47 and pulls short link 42 forward. Short link 42 pivots upon short link 41 at pivot 44 and the two links 41, 42 generally align as shown in FIG. 2. Link 42 pivotally attaches to tray 18 at pivot 45. Short link 42 pulls the upper end 49 of paper storage tray 18 forward in the direction of arrow 48. This action rotates tray 18 upon its pivot 19. The lower end 50 of storage tray 18 rotates rearwardly in the direction of arrow 51 (FIGS. 1 and 2).

The lower end 50 of paper storage tray 18 has a projection 52 that engages a correspond placed projection 53 on paper exit tray 13. In this fashion, rotating the locking member 30 from the printing position 32 to the carrying position 31 secures several components of the printer, including the carrier 23 and its print head 20, the paper storage tray 18 and the paper exit tray 13.

Cover 15 can also be secured when locking member 30 is rotated from printing position 32 to transport position 31. In FIGS. 1 and 2, a cover locking arm 54 is rotatably mounted to chassis 11 at bearing 55. Locking arm 54 has end portions 56, 57.

End portion 56 can be sized and shaped to engage the rear portion 58 of cover 15 when cover 15 is closed as shown in FIG. 2. When cover locking arm 54 is so positioned, as can occur when cover 15 is closed, end portion 57 of arm 54 is positioned to mate with recess 59 at upper end 49 of paper storage tray 18. In this fashion, a user can first close cover 15 when printer 10 is to be transported. Cover locking arm 54 can then be positioned manually to the position shown in FIG. 2 by rotating arm 54 upon its bearing 55. With the cover 15 closed and arm 54 generally horizontally positioned as shown in FIG. 2, the user then rotates locking member 30 to the carrying position 31 of FIG. 2. Cover locking arm 54 engages recess 59 so that it will not rotate about its bearing 55. Cover 15 is prevented from opening because end 56 engages rear portion 58 of cover 15. As aforedescribed, the carrier 23, paper tray 18 and exit tray 13 are also locked when locking member 30 rotates to position 31 of FIG. 2.

In FIGS. 3–6, an alternate arrangement is shown for locking the cover 15. Cover locking arm 60 rotates or pivots upon a vertical pivot 61 on chassis 11. Cover 15 has a rear portion 62 with recess 63 that receives an end portion 64 of arm 60 (see FIGS. 4 and 5). When paper storage tray 18 is rotated forward by movement of handle 30 from printing position 32 to carrying position 31, a side panel 66 of paper tray 18 engages locking arm 60 and rotates it to the locking position of FIG. 4 wherein one end 64 engages recess 63 of cover rear portion 62. This engagement of locking arm 60 in recess 63 thus prevents opening of cover 15.

PARTS LIST

The following is a list of parts and materials suitable for use in the present invention:

| PART NUMBER | DESCRIPTION |
|---|---|
| 10 | ink jet printer |
| 11 | chassis |
| 12 | lower end portion |
| 13 | paper exit tray |
| 14 | upper end portion |
| 15 | cover |
| 16 | front |
| 17 | rear |
| 18 | paper storage tray |
| 19 | pivot |
| 20 | print head |
| 21 | rail |
| 22 | bearing surface |
| 23 | ink jet carrier |
| 24 | maintenance station position |

-continued

| PART NUMBER | DESCRIPTION |
|---|---|
| 25 | locking linkage |
| 26 | first end portion |
| 27 | arrow |
| 28 | second end portion |
| 29 | carrier lock |
| 30 | locking member (handle) |
| 31 | carrying position |
| 32 | printing position |
| 33 | upper end portion |
| 34 | lower end portion |
| 35 | pivot |
| 36 | cam surface |
| 37 | pivot |
| 38 | gripping surface |
| 39 | arrow |
| 40 | larger link |
| 41 | smaller link |
| 42 | smaller link |
| 43 | pivot |
| 44 | pivot |
| 45 | pivot |
| 46 | arrow |
| 47 | arrow |
| 48 | arrow |
| 49 | upper end |
| 50 | lower end |
| 51 | arrow |
| 52 | projection |
| 53 | projection |
| 54 | cover locking arm |
| 55 | bearing |
| 56 | end portion |
| 57 | end portion |
| 58 | rear portion |
| 59 | recess |
| 60 | cover locking arm |
| 61 | vertical pivot |
| 62 | rear portion |
| 63 | recess |
| 64 | end portion |
| 65 | end portion |
| 66 | side panel |

The foregoing embodiments are presented by way of example only; the scope of the present invention is to be limited only by the following claims.

What is claimed is:

1. An easily transportable ink jet printer apparatus, comprising:

a) a chassis that includes an ink jet carrier having nozzles for dispensing ink, a print head being movably mounted to the chassis along a travel path, wherein the ink jet carrier has a parked position when not printing in which the nozzles are capped to prevent clogging of the nozzles by dried ink; and b) a handle that is movably mounted to the chassis between carrying and printing positions, wherein the handle holds the print head in the parked position when the handle is moved into the carrying position.

2. The ink jet printer apparatus of claim 1 further comprising a carrier lock that is movably attached to the chassis, the carrier lock occupying a locking position in between the handle and the print head when the handle is moved to the carrying position.

3. The ink jet printer apparatus of claim 2 wherein the carrier lock has an end portion that at times engages the handle during use.

4. The ink jet printer apparatus of claim 1 wherein the chassis has a movable access cover that is locked in the carrying position when the handle is moved to a carrying position.

5. The ink jet printer apparatus of claim 4 wherein the chassis has an access cover and an exit tray, and both the access cover and exit tray are secured when the handle is moved to the carrying position.

6. The ink jet printer apparatus of claim 1 wherein the handle has a cam with a cam surface that is positioned to contact the print head in the carrying position.

7. The ink jet printer apparatus of claim 2 wherein the handle has a cam with a cam surface that contacts the print head when the handle is moved to the carrying position.

8. The ink jet printer apparatus of claim 7 wherein the cam surface pushes the carrier lock to engage the print head in the locking position.

9. The ink jet printer apparatus of claim 8 wherein the cam closes the paper storage tray when the handle is moved to the carrying position.

10. The ink jet printer apparatus of claim 9 wherein the carrier lock drops into the travel path of the print head when the exit paper tray is closed to prevent the carrier from moving out of the capped position during transport.

11. The ink jet printer apparatus of claim 10 wherein closing the paper tray activates latches for the access cover and paper exit tray.

12. The ink jet printer apparatus of claim 11 wherein the exit tray latch is adapted to be cantilevered to allow the exit tray to be stored while the latch is locked.

13. The ink jet printer apparatus of claim 12 wherein the exit tray is held in the closed position until the paper tray is opened.

14. The ink jet printer apparatus of claim 13 wherein the access cover allows the cover to be opened before any damage can occur in case the user attempts to lift the printer by gripping the cover.

15. An easily transportable ink jet printer apparatus, comprising:

a) a chassis that includes a paper storage tray movably mounted to the chassis between printing and carrying positions, an ink jet print head having nozzles for dispensing ink, the print head being movably mounted to the chassis along a travel path, wherein the ink jet print head has a parked position when not printing in which the nozzles are capped to prevent clogging of the nozzles by dried ink; and b) a paper tray locking linkage that enables a user to safely transport the chassis, the linkage including a handle that is movably mounted upon the chassis between locking and unlocking positions, wherein the locking linkage holds the paper tray in a secured carrying position when the handle is moved to the locking position.

16. The ink jet printer apparatus of claim 15 wherein the paper tray locking linkage includes the handle and a carrier lock movably mounted to the chassis, the carrier lock having a portion that engages the paper tray.

17. The ink jet printer apparatus of claim 16 wherein the handle has a cam with a cam surface.

18. The ink jet printer apparatus of claim 17 wherein the paper tray locking linkage has an end portion that is attached to the handle.

19. The ink jet printer apparatus of claim 17 wherein the paper tray locking linkage has an end portion that is attached to the cam.

20. The ink jet printer apparatus of claim 15 further comprising a carrier lock that is movably attached to the frame, the carrier lock occupying a locking position in between the handle and the print head when the handle is moved to the carrying position.

21. The ink jet printer apparatus of claim 15 wherein the chassis has an access cover and the access cover is locked when the handle is moved to the carrying position.

22. The ink jet printer apparatus of claim 15 wherein the chassis has an access cover and an exit tray and each of the access cover and exit trays are secured when the handle is moved to the carrying position.

23. The ink jet printer apparatus of claim 19 wherein the cam has a cam surface that is positioned to contact the print head in the carrying position.

24. The ink jet printer apparatus of claim 23 wherein the cam surface pushes the carrier lock into the locking position that contacts the print head when the handle is moved to the carrying position.

25. The ink jet printer apparatus of claim 24 wherein the cam closes the paper tray when the handle is moved to the carrying position.

26. The ink jet printer apparatus of claim 25 wherein the carrier lock drops into the travel path of the print head when the exit paper tray is closed and prevents the print head from moving out of the capped position during transport.

27. The ink jet printer apparatus of claim 26 wherein the locking linkage includes a plurality of latches and closing the paper tray activates latches that secure the access cover and paper exit tray.

28. The ink jet printer apparatus of claim 27 wherein the exit tray latch is cantilevered enabling the exit tray to be stored while the latch is locked.

29. The ink jet printer apparatus of claim 28 wherein the exit tray is held in the closed position with a latch until the paper tray is opened.

30. An easily transportable ink jet printer apparatus, comprising:

a) a chassis that includes a paper storage tray, a paper exit tray, an ink jet print head having nozzles for dispensing ink, the print head being movably mounted to the chassis, and a paper handling mechanism that moves paper from the storage tray to the print head to the exit tray, wherein the ink jet print head has a parked position when not printing in which the nozzles are capped to prevent clogging of the nozzles by dried ink; and b) a locking mechanism on the chassis that includes a handle that is movably mounted to the chassis between carrying and printing positions, wherein the handle locks the paper exit tray when moved to the "carrying" position.

31. The ink jet printer apparatus of claim 30 wherein the locking mechanism includes the handle and a locking linkage that attaches at one end to the handle and at another end to the paper storage tray.

32. The ink jet printer apparatus of claim 31 wherein the locking mechanism includes the paper storage tray.

33. The ink jet printer apparatus of claim 32 wherein the locking mechanism includes a latch on the paper storage tray that locks the paper exit tray.

34. The ink jet printer apparatus of claim 30 wherein the handle moves the locking linkage and the attached paper storage tray to a carrying position when the handle is moved to the storage position.

35. The ink jet printer apparatus of claim 30 wherein the paper exit tray is located below the paper storage tray.

36. The ink jet printer apparatus of claim 30 wherein the paper exit tray is generally horizontally positioned.

37. The ink jet printer apparatus of claim 30 wherein the paper exit tray is positioned at the bottom of the chassis.

38. The ink jet printer apparatus of claim 37 wherein the paper storage tray extends upwardly from a position at the bottom of the chassis.

39. The ink jet printer apparatus of claim 30 wherein the handle is positioned at the upper end portion of the chassis and the paper exit tray is positioned at the lower end portion of the chassis.

40. An ink jet printer apparatus, comprising:

a) a chassis that includes a paper storage tray movably mounted on the chassis between printing and carrying positions, an ink jet print head having nozzles for dispensing ink, the print head being movably mounted to the chassis, and a paper handling mechanism that moves paper from the storage tray to the print head, wherein the ink jet print head has a parked position when not printing in which the nozzles are capped to prevent clogging of the nozzles by dried ink; and b) a locking member that is movably mounted to the chassis between carrying and printing positions, wherein the locking member holds the print head in the parked position when the locking member is moved into the carrying position.

41. The ink jet printer apparatus of claim 40 further comprising a locking linkage that activates the locking member.

42. The ink jet printer apparatus of claim 40 wherein the locking member has a cam with a cam surface that secures the print head.

43. The ink jet printer apparatus of claim 42 wherein the cam surface pushes the locking member into a locking position and simultaneously closes the paper storage tray.

44. The ink jet printer apparatus of claim 41 wherein the linkage includes a cam with a cam surface.

45. The ink jet printer apparatus of claim 44 wherein the locking linkage extends between the paper tray and the cam.

46. The ink jet printer apparatus of claim 45 wherein the locking member is pivotally attached to the chassis.

47. The ink jet printer apparatus of claim 45 further comprising a locking linkage that extends between the locking member and the paper storage tray.

48. The ink jet printer apparatus of claim 40 further comprising an access cover and a paper exit tray mounted on the chassis.

49. The ink jet printer apparatus of claim 48 wherein closing the paper tray activates latches for the access cover and paper exit tray.

50. An ink jet printer apparatus, comprising:

a) a chassis that includes a paper storage tray movably mounted on the chassis between printing and carrying positions, an ink jet print head having nozzles for dispensing ink, the print head being movably mounted to the chassis, and a paper handling mechanism that moves paper from the storage tray to the print head, wherein the ink jet print head has a parked position when not printing in which the nozzles are capped to prevent clogging of the nozzles by dried ink; and b) a locking device that is movably mounted to the chassis between locked and unlocked positions, the locking device holding the print head in the parked position and the paper tray in the storage position.

51. The ink jet printer apparatus of claim 50 wherein the chassis has an access cover and the access cover is locked when the locking device is moved to the carrying position.

52. The ink jet printer apparatus of claim 50 wherein the chassis has an access cover and an exit tray and each of the access cover and exit trays are secured when the locking device is moved to the carrying position.

53. The ink jet printer apparatus of claim 50 wherein the locking device has a cam with a cam surface.

* * * * *